US009782914B2

(12) United States Patent
Sodhi et al.

(10) Patent No.: US 9,782,914 B2
(45) Date of Patent: Oct. 10, 2017

(54) CORRELATING ENERGY TO MIX CEMENT SLURRY UNDER DIFFERENT MIXING CONDITIONS

(71) Applicant: HALLIBURTON ENERGY SERVICES, INC., Houston, TX (US)

(72) Inventors: Thomas Singh Sodhi, New Caney, TX (US); Pauline Akinyi Otieno, Spring, TX (US); Vivek S. Goel, Humble, TX (US); Benjamin John Iverson, Sprint, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 121 days.

(21) Appl. No.: 14/412,036

(22) PCT Filed: Oct. 31, 2013

(86) PCT No.: PCT/US2013/067874

§ 371 (c)(1),
(2) Date: Dec. 30, 2014

(87) PCT Pub. No.: WO2015/065456

PCT Pub. Date: May 7, 2015

(65) Prior Publication Data

US 2016/0271834 A1 Sep. 22, 2016

(51) Int. Cl.

| | |
|---|---|
| ***B28C 7/02*** | (2006.01) |
| ***E21B 33/13*** | (2006.01) |
| ***E21B 21/06*** | (2006.01) |
| ***B01F 15/00*** | (2006.01) |
| ***E21B 33/14*** | (2006.01) |
| ***B28C 9/00*** | (2006.01) |

(52) U.S. Cl.
CPC ..... *B28C 7/026* (2013.01); *B01F 15/00201* (2013.01); *B28C 9/004* (2013.01); *E21B 21/062* (2013.01); *E21B 33/13* (2013.01); *E21B 33/14* (2013.01)

(58) Field of Classification Search
CPC ..... B28C 7/026
USPC ..... 366/2, 64, 142
See application file for complete search history.

(56) References Cited

U.S. PATENT DOCUMENTS

| | | | | |
|---|---|---|---|---|
| 2,266,733 | A * | 12/1941 | Bays | G01N 11/14 366/140 |
| 3,237,241 | A * | 3/1966 | Gagliardi | B29B 7/582 366/142 |
| 3,727,894 | A * | 4/1973 | Ahrenberg | B22C 5/08 366/17 |
| 3,826,476 | A * | 7/1974 | Ahrenberg | B22C 5/08 366/17 |
| 2003/0125425 | A1 | 7/2003 | Lee | |
| 2005/0201197 | A1 * | 9/2005 | Duell | B01F 3/1221 366/136 |
| 2007/0007006 | A1 | 1/2007 | Massingill et al. | |
| 2010/0039125 | A1 | 2/2010 | Buchler | |
| 2013/0002268 | A1 | 1/2013 | Kumar et al. | |
| 2013/0145967 | A1 | 6/2013 | Koehler et al. | |

OTHER PUBLICATIONS

Authorized Officer Sung Cheal Byun, PCT International Search Report and Written Opinion of the International Searching Authority, PCT/US2013/067874, dated Jul. 25, 2014, 10 pages.
Orban et al., "Specific Mixing Energy: A Key Factor for Cement Slurry Quality," SPE 15578, Copyright 1986, 8 pages.
Heathman, J. F., et al., "A Study of the Effects of Mixing Energy Imparted on Cement Slurries by Field Equipment and Coiled Tubing," SPE 26573, Oct. 6, 1993, 14 pages.
Vickery, C. M., et al., "Experimental Mixing Energy Evaluation of Foam Cements Within Laboratory Blenders," ETCE2000.DRILL-10095, Proceedings of ETCE/OMAE 2000 Joint Conference Energy for the New Millenium, Feb. 14-17, 2000, 6 pages.

* cited by examiner

*Primary Examiner* — David Sorkin
(74) *Attorney, Agent, or Firm* — John Wustenberg; Parker Justiss, P.C.

(57) ABSTRACT

One example of correlating energy to mix well cement slurry under laboratory conditions to field conditions can be implemented as a method to determine energy to mix cement slurry. Electrical power supplied to an electric mixer in mixing a specified well cement slurry is measured. An energy to mix the specified well cement slurry is determined from the measuring. The determined energy to mix the specified well cement slurry and specifications of field equipment for use in mixing the specified well cement slurry at a well site are compared. The field equipment is a different configuration than the electric mixer. Based on the comparing, it is determined whether the well cement slurry needs redesigning according to capabilities of the field equipment.

10 Claims, 3 Drawing Sheets

CORRELATING ENERGY TO MIX CEMENT SLURRY UNDER DIFFERENT MIXING CONDITIONS

TECHNICAL FIELD

This disclosure relates to mixing oil-well fluids, including but not limited to oil-well cement slurries.

BACKGROUND

Cement compositions may be used in a variety of subterranean operations, such as, in the production and exploration of hydrocarbons, e.g., oil, gas, and other hydrocarbons, onshore and offshore. For example, a subterranean well can be constructed using a pipe string (e.g., casing, liners, expandable tubulars, etc.), which can be run into a wellbore and cemented in place. The process of cementing the pipe string in place is commonly referred to as "primary cementing." In a typical primary cementing method, a cement composition can be pumped into an annulus between the walls of the wellbore and the exterior surface of the pipe string disposed therein. The cement composition can set in the annular space, thereby forming an annular sheath of hardened, substantially impermeable cement (i.e., a cement sheath). The cement sheath can support and position the pipe string in the wellbore and bond the exterior surface of the pipe string to the subterranean formation. The cement sheath surrounding the pipe string functions to prevent the migration of fluids in the annulus among other things, and to protect the pipe string from corrosion.

A broad variety of well cement compositions have been used in subterranean well cementing operations. Such well cement compositions can be made by mixing portland cement with water and often with one or more other additives such are retarders, accelerators, lightweight additives. The additives can be either dry powder, or liquid or both. The components are mixed under certain mixing conditions (e.g., mixing speeds, mixing times, and other conditions). For example, industry guideline specifications for laboratory experiments designed to mimic field operations, which include quantities and mixing conditions, for mixing a specified volume of a cement slurry are provided, e.g., by institutions such as the American Petroleum Institute (API) or other institutions.

A variety of mixing equipment are employed in the field to mix the broad variety of cement compositions. Examples of such mixing equipment include batch mixers and RCM® IIIr Mixers (a Halliburton Energy Services Inc. mixing system). Certain mixing equipment, e.g., mixing equipment implemented under laboratory conditions, can be used to mix a specified volume of well cement slurry according to the industry guideline specifications (e.g., the API specifications). For example, the laboratory mixing equipment can mix the specified volume under API specifications such as specified time and mixing RPM. In some situations, additives are incorporated into the well cement slurry or larger volumes of slurry are mixed (or both). The energy consumed by the mixing process in those situations may exceed the energy consumed during mixing in other situations. Capabilities are available to modify the mixing equipment to provide the additional energy to mix the well cement slurry with the additives or the larger volumes of well cement slurry (or both). The mixing capabilities of different mixing equipment to mix well cement slurry can differ. For example, the capabilities of field equipment, i.e., equipment used at or near a well site to mix well cement slurry, can differ from the mixing capabilities of other equipment, e.g., the mixing equipment used under laboratory conditions. The difference in capabilities can affect the mixability of the well cement slurry under industry guideline specifications or the quality of the mixed well cement slurry (or both).

DESCRIPTION OF DRAWINGS

Like reference symbols in the various drawings indicate like elements.

DETAILED DESCRIPTION

Figure 1:
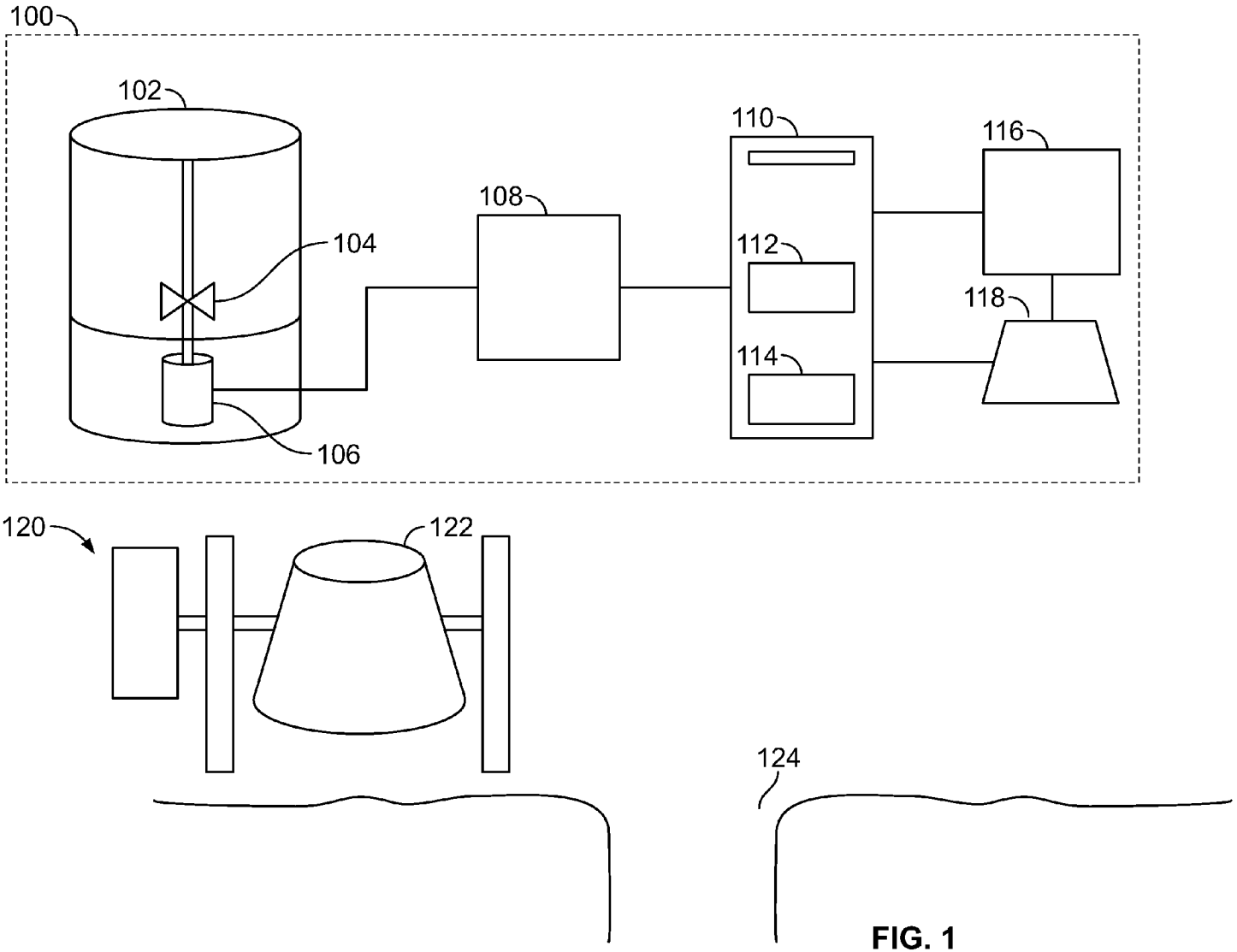
FIG. 1 illustrates example conditions for mixing a well cement slurry.

This disclosure relates to correlating the energy to mix well cement slurries under two different mixing conditions, each of which implements mixing equipment having different capabilities. The disclosure describes techniques to correlate a process of mixing a well cement slurry under industry guideline specifications, e.g., using laboratory mixing equipment to mixing the well cement slurry under the same or similar specifications, e.g., using field mixing equipment. Well cement slurry is an example of cement slurry to which the techniques described here are applicable; the techniques are applicable to other cement slurries, e.g., non-well cement slurries. The wettability of the dry components (such as the portland cement and the dry additives used), and the difference in shear history and mixing energy between the mixing equipment implemented under laboratory conditions and the field equipment are some of the factors that affect the correlation. Correlating the mixing under the different mixing conditions can allow scaling the mixing process, e.g., from a smaller scale such as that implemented using a small laboratory mixing equipment to a larger scale such as that implemented using relatively larger field mixing equipment.

Knowing an energy input to the mixing process can enable correlating a mixing process implemented under a first set of mixing conditions, e.g., laboratory conditions, with the process implemented under a second set of mixing conditions, e.g., field conditions, that are different from the first set. This disclosure describes techniques to directly measure the energy, e.g., as Mechanical Energy Input (MEI), during mixing of a cement slurry using a first type of mixing equipment, e.g., laboratory mixing equipment, and to correlate an order of magnitude MEI to mix the cement slurry using a second type of mixing equipment, e.g., field equipment, that has different mixing capabilities relative to the first type. Knowing the MEI during the mixing process can enable a determination of the gap between the industry guideline specifications and the field equipment mixing capabilities. The gap can be used to determine when a cement slurry will be mixable under the second set of mixing conditions, e.g., in the field based on the first set of mixing conditions, e.g., the laboratory mixing energy data. The techniques described here can decrease (or eliminate) a need to incorporate approximations into the operational procedure to evaluate the energy utilized in the mixing process. Relative to the approximation-based techniques, the quantitative techniques described here can be more direct and more reliable. The direct measurement of energy instead of approximation can increase a portability of the techniques across environments that implement the first set of mixing conditions to determine mixing energy. The techniques described here also decreases or eliminate a need for calibration and any apriori determination of constants of approximation. Furthermore, the techniques allow for the potential decrease or elimination of the current disconnect between blending equipment of various sizes and geometries.

FIG. 1 illustrates example conditions for mixing a cement slurry. A specified cement slurry can be mixed under a first set of mixing conditions, e.g., laboratory conditions in a laboratory environment 100. Under the first set of mixing conditions, mixing equipment of a first type can be implemented to mix a specified volume of cement slurry under industry guideline specifications. For example, the laboratory environment 100 can include an electric mixer 102 to mix the specified cement slurry under API specifications or other industry guideline specifications. The electric mixer 102 can include, e.g., mixing blades 104 connected to a motor 106 to rotate the mixing blades 104. The electric mixer 102 can be connected to a measurement device 108 to directly measure electrical power supplied to the mixer in mixing the specified cement slurry. In some implementations, the measurement device 108 can be a multimeter connected to the motor 106 to measure parameters to determine the electrical power, e.g., a voltage across the motor 106, a current through the motor 106, other parameters or combinations of them.

The measurement device 108 can be connected to a computer system 110 which includes one or more processors 112 and a computer-readable medium 114 storing instructions executable by the one or more processors 112 to correlate the mechanical energy to mix the cement slurry under the laboratory conditions and under field conditions. The computer system 110 can include any computer, e.g., a desktop computer, a laptop computer, a smartphone, a tablet computer, a personal digital assistant (PDA) or other computer. The computer system 110 can be connected to one or more input devices 116 and one or more output devices 118. In some implementations, the computer system 110 can be implemented as hardware or firmware integrated into the measurement device 108. Alternatively, or in addition, the measurement device 108 can be integrated into the computer system 110. In some implementations, data from the measurement device 108 can be manually input into the computer system 110, e.g., using the one or more input devices 116.

Figure 2:
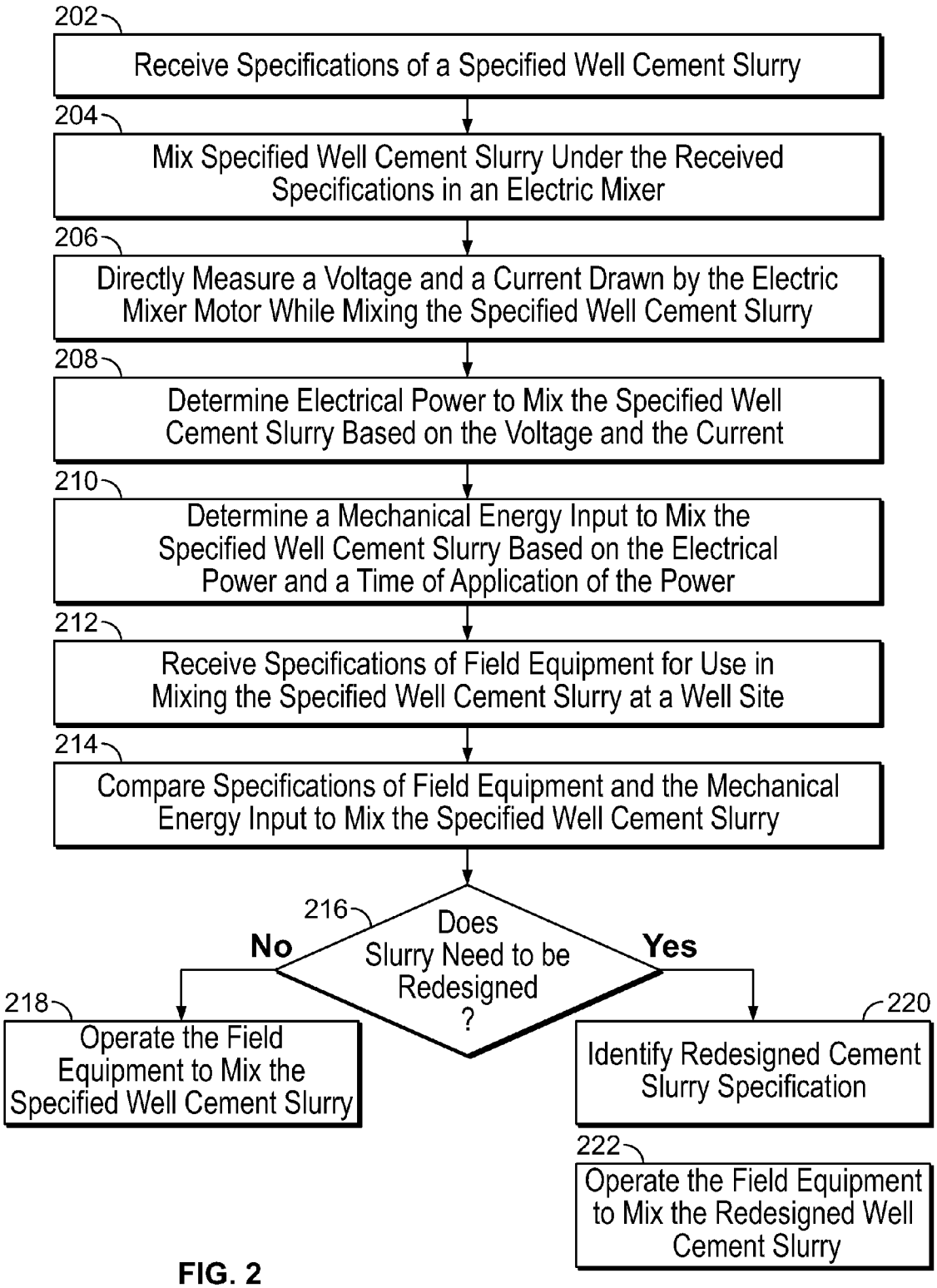
FIG. 2 is a flowchart of an example process to correlate energy to mix a cement slurry under a first set of mixing conditions to a second set of mixing conditions.

FIG. 2 is a flowchart of an example process 200 to correlate energy to mix cement slurry under a first set of mixing conditions, e.g., laboratory conditions, to a second set of mixing conditions, e.g., field conditions that are different from the laboratory conditions. In some implementations, at least a portion of the process 200 can be implemented by the electric mixer 102, the measurement device 108, the computer system 110 or combinations of them. In some implementations, at least a portion of the process 200 can be implemented by the electric mixer 102, the measurement device 108, an operator, or combinations of them. At 202, specifications of a specified cement slurry can be received. The specifications include a speed of mixing (e.g., a speed at which the mixing blades 104 are to be rotated), a time of mixing (e.g., in minutes, hours, or other times), a quantity of each cement slurry component to be mixed, a quantity of water (or other fluid) to be added to mix the multiple components, a quantity of wetness or quantity of homogeneity of the mixed cement slurry, combinations of them, or other specifications. In certain instances, the speed and time of mixing, can be specified in the industry guideline specifications, e.g., the API.

At 204, the components of the specified well cement slurry can be mixed under the received specifications. To do so, respective quantities of components of the specified well cement slurry (e.g., hydraulic cement, water, additives, or other components) can be added to the electric mixer 102. In some implementations, dry additives can also be added to the liquids that comprise the specified well cement slurry. In one example instance, the motor 106 can be operated to rotate the mixing blades 104 at the speed of mixing and for the time of mixing to mix the multiple components to produce the specified well cement slurry. For example, mixing the components under the API specifications can result in the specified well cement slurry having the quantity of wetness or the quantity of homogeneity (or both) specified in the API specifications. Similarly, in other example instances, the motor 106 can be operated to rotate the mixing blades 104 at respective (e.g., different) speeds of mixing and for respective (e.g., different) times of mixing to mix the multiple components to produce the specified well cement slurry. In this manner, in multiple instances of mixing, well cement slurry can be mixed at different mixing speeds or different mixing times or both.

At 206, a voltage across and a current drawn by the electric mixer 102 can be directly measured while mixing the specified well cement slurry. In some implementations, the measurement device 108 (e.g., the multimeter) can be directly connected to the motor 106 to measure the voltage across and the current drawn by the motor 102 while mixing. The measurement device 108 can be implemented to obtain multiple measurements of voltage and current, each measurement corresponding to a respective instance of operating the motor 106 at a mixing speed for a mixing time.

At 208, the energy to mix the specified well cement slurry can be determined based on the measured voltage and the current. In some implementations, the measurement device 108 can transmit the measured voltage and current to the computer system 110, which can implement computer operations to determine the electrical power, e.g., as a product of voltage and current. For example, the voltage and current can be measured for a period of time in the laboratory environment 100 under the laboratory conditions. The electrical power can be determined as a product of a time-averaged voltage and a time-averaged current. For the multiple instances of operating the motor 106, the computer system 110 can determine multiple values of electrical power, each value being a product of a respective time-averaged voltage and time-averaged current.

Upon measuring the electrical power supplied to the electric mixer 102, the energy to mix the specified well cement slurry from the measuring can be determined at 210. In some implementations, the energy can be electrical energy determined as a product of electrical power and the time of application of the electrical power. For example, the computer system 110 can determine a Mechanical Energy Input (MEI) to mix the specified well cement slurry based on the electrical power using Equation 1 shown below.

$$MEI_{mixer} \approx 0.00134\frac{[(V \times I) \times t]}{\text{Volume}} = \left(\frac{\text{hp}\cdot\text{min}}{\text{bbl}}\right) \quad \text{(Equation 1)}$$

In Equation 1, $MEI_{mixer}$ represents MEI when the well cement slurry is mixed under laboratory conditions, and V and I represent voltage and current, respectively, averaged over the total mixing time, t. In some implementations, the functionality to determine the electrical power and the MEI can be integrated into the measurement device 108. Also, the computer system 110 can determine multiple MEI values for the multiple instances of mixing described above.

At 212, specification of a second type of mixing equipment, e.g., field equipment 122 for use in mixing the specified well cement slurry at a well site 124 can be received. The field equipment 122 can be of a different configuration than the electric mixer 102. For example, the field equipment 122 can be a hydraulic mixer, a static mixer, an agitator system or other mixer that is different from the electric mixer 102. An example of a hydraulic mixer is the RCM® IIIr Mixer (a Halliburton Energy Services Inc. mixing system). The computer system 110 can receive the specifications of the hydraulic mixer, which can include a maximum pressure drop across the hydraulic mixer, a maximum volumetric flow rate of the hydraulic mixer, a maximum rotational speed of the hydraulic mixer, combinations of them, or other specifications.

In some implementations, the computer system 110 can determine, based in part on the specifications of the second type of equipment, a maximum energy that the second type of equipment can output to prepare the specified well cement slurry under the second set of mixing conditions, e.g., the field conditions, according to Equation 2.

For example, for a field equipment having a pressure drop and volumetric flow rate of ΔP and Q, respectively, the computer system 110 can determine an MEI for the field equipment 122 using Equation 2 shown below.

$$MEI_{field\ equipment} = \frac{\Delta P \times Q}{\text{Volume}} = \left(\frac{\text{hp}\cdot\text{min}}{\text{bbl}}\right) \quad \text{(Equation 2)}$$

Based on a comparison of the MEI of the field equipment 122, when mixing the well cement slurry under the industry guideline specifications in the field environment 120, and the MEI for the electric mixer 102 to mix the well cement slurry under the industry guideline specifications in the laboratory environment 100, a determination is made as to whether or not the well cement slurry can be mixed using the field equipment 122, as described below.

At 214, the energy to mix the specified well cement slurry under the first set of mixing conditions, e.g., the laboratory conditions, and the specifications of the second type of equipment, e.g., the field equipment, can be compared. For example, the computer system 110 can compare the MEI determined for the field equipment 122 using Equation 2, which represents the maximum energy that the field equipment 122 can output, with the MEI determined for the electric mixer 102 determined using Equation 1.

Based on the comparing, at 216, a check can be performed to determine the well cement slurry that was mixed using the first type of mixing equipment, i.e., the laboratory mixing equipment, can be used as-is with the second type of mixing equipment, i.e., the field equipment, or if the well cement slurry needs to be re-designed. In the absence of industry guideline specifications for mixing in the field and because different mixing equipment have different manufacturer-specified mixing properties, the comparison of the MEIs, as described above, can be beneficial to determine the applicability of an available field equipment to mix a well cement slurry. For example, based on the comparing, the computer system 110 or an operator (or both) can determines that the well cement slurry can be mixed as-is using the field equipment 122. The computer system 110 can provide a notification of the determination, e.g., in the output devices 116. In response, at 218, the field equipment 122 can be operated to mix the specified well cement slurry. For example, an operator can operate the field equipment 122 under the industry guideline specifications to mix the well cement slurry.

Instead, based on the comparison, the computer system 110 or the operator (or both) can determine that the well cement slurry needs to be re-designed to be mixable by the field equipment 122. The computer system 110 can provide a notification of the determination, e.g., in the output devices 116. In response, at 220, the well cement slurry can be redesigned according to the specifications of the field equipment 122. For example, the well cement slurry can be redesigned to meet the specifications or mixing capabilities (or both) of the available field equipment.

At 220, the second type of mixing equipment, e.g., the field equipment can be operated to mix the re-designed well cement slurry. In this manner, a direct measurement of MEI from the electrical mixer 102 operated under laboratory conditions can be correlated with field equipment 122 to determine mixability of well cement slurry. In particular, the direct measurement decreases (or avoids) a need for approximation of constants to determine the energy consumed by the electrical mixer 102.

Figure 3:
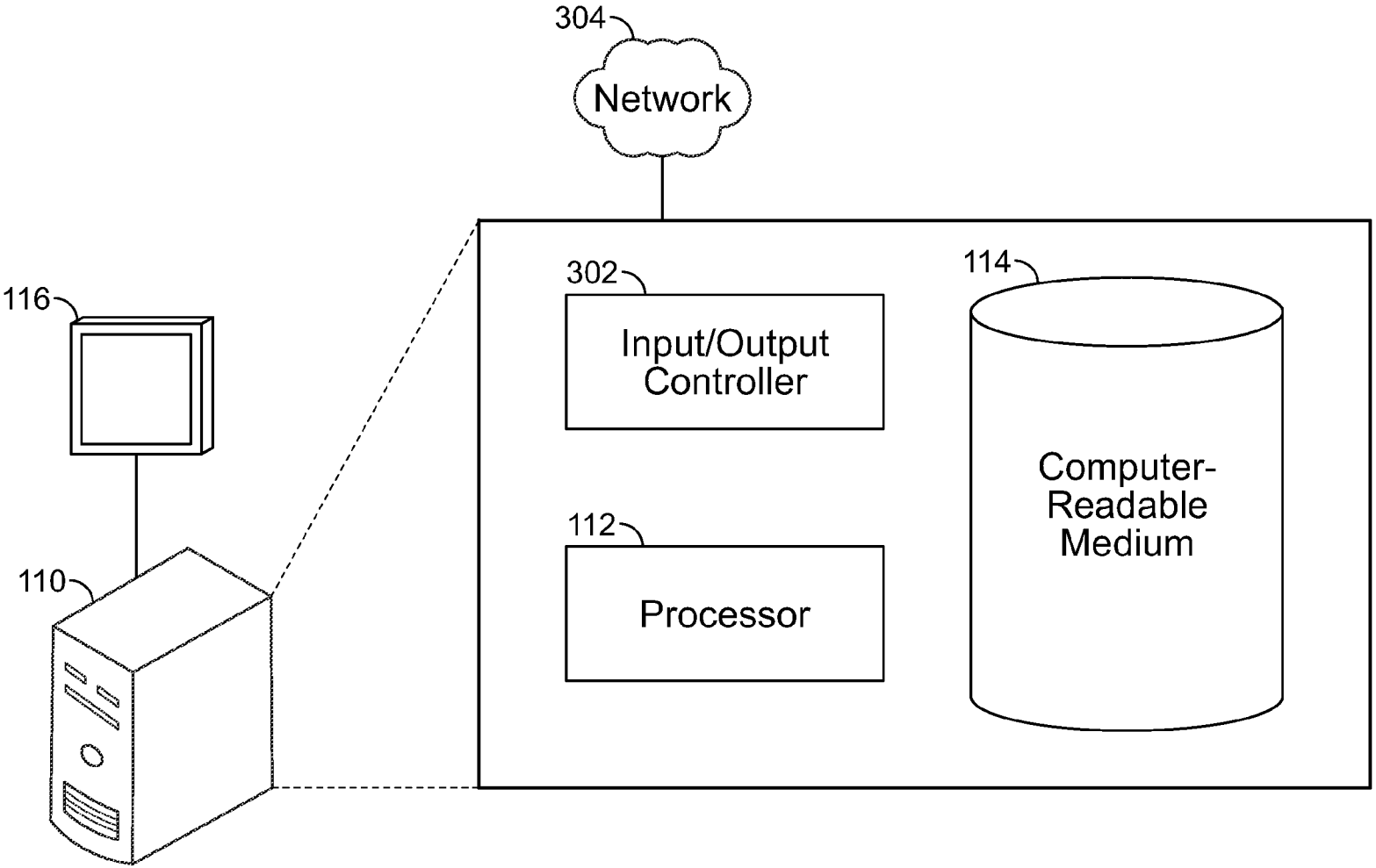
FIG. 3 illustrates a schematic of an example computer system of FIG. 1.

FIG. 3 illustrates a schematic of an example computer system 110 of FIG. 1. The computer system 110 can be connected to the first type of mixing equipment that mixes the well cement slurry under the first set of mixing conditions. For example, the computer system 110 can be located in the laboratory environment 100, i.e., an environment in which mixing under laboratory conditions can be recreated. The computer system 110 can include one or more processors 112, a computer-readable medium 114 (e.g., a memory), and input/output controllers 302 communicably coupled by a bus. The computer-readable medium 114 can include, for example, a random access memory (RAM), a storage device (e.g., a writable read-only memory (ROM) and/or others), a hard disk, and/or another type of storage medium. The computer system 110 can be preprogrammed and/or it can be programmed (and reprogrammed) by loading a program from another source (e.g., from a CD-ROM, from another computer device through a data network, and/or in another manner). The input/output controller 302 is coupled to input/output devices (e.g., the display device 116, input devices 118, and/or other input/output devices) and to a network 304. The input/output devices receive and transmit data in analog or digital form over communication links such as a serial link, wireless link (e.g., infrared, radio frequency, and/or others), parallel link, and/or another type of link.

The network 304 can include any type of data communication network. For example, the network 304 can include a wireless and/or a wired network, a Local Area Network (LAN), a Wide Area Network (WAN), a private network, a public network (such as the Internet), a WiFi network, a network that includes a satellite link, and/or another type of data communication network A number of implementations have been described. Nevertheless, it will be understood that various modifications may be made without departing from the spirit and scope of the disclosure.

The invention claimed is:

1. A method to determine a cement slurry design, the method comprising:

using a computer to measure electrical power supplied to an electric mixer in mixing a specified well cement slurry and determine an energy to mix the specified well cement slurry from the measuring;

using a computer to compare the energy to mix the specified well cement slurry from the measuring with an energy required to mix the specified well cement slurry using field equipment for mixing the specified well cement slurry at a well site, the field equipment being of a different configuration than the electric mixer;

using a computer to make a determination, based on the comparing, whether the specified well cement slurry needs redesigning according to capabilities of the field equipment;

identifying a redefined cement slurry specification; and operating the field equipment according to the redefined cement slurry specification to achieve a redefined well cement slurry when the redefined cement slurry specification requires a redefining of the cement slurry.

2. The method of claim 1, wherein using a computer to measure the electrical power supplied to the electric mixer comprises measuring the electrical power in a laboratory environment.

3. The method of claim 1, further comprising determining a mechanical energy input (MEI) to mix the specified well cement slurry based, at least in part, on the electrical power.

4. The method of claim 1, wherein using a computer to compare the measured energy to mix the specified well cement slurry with the energy required to mix the specified well cement slurry using the field equipment comprises:

determining, based at least in part on the specifications of the field equipment, a maximum energy that the field equipment can output to prepare the specified well cement slurry in the field; and comparing the determined energy to mix the specified well cement slurry and the maximum energy that the field equipment can output.

5. The method of claim 4, wherein, based on the comparing, determining whether the well cement slurry needs redesigning comprises determining that the well cement slurry does not need redesigning and that the well cement slurry is mixable using the field equipment.

6. The method of claim 4, wherein the field equipment is a hydraulic mixer and wherein the specifications of the hydraulic mixer comprise at least one of a maximum pressure drop across the hydraulic mixer, a maximum volumetric flow rate of the hydraulic mixer, or a maximum rotational speed of the hydraulic mixer.

7. The method of claim 4, wherein, based on the comparing, whether the well cement slurry needs redesigning comprises determining that the well cement slurry needs redesigning to be mixable using the field equipment, and further determining a well cement slurry specification at which the field equipment is operable to mix the specified well cement slurry.

8. The method of claim 7, wherein the well cement slurry specification comprises a different time to mix the plurality of cement slurry components relative to a time to mix the well cement slurry in the electric mixer.

9. The method of claim 1, further comprising receiving a well cement slurry specification to mix the specified well cement slurry in the electric mixer, the well cement slurry specification comprising at least one of a speed and a time of mixing, a quantity of each well cement slurry component to be mixed to prepare the well cement slurry, or a quantity of water to be added.

10. The method of claim 1, wherein the specified well cement slurry is defined by at least one of a quantity of wetness and a quantity of homogeneity of the well cement slurry.

* * * * *